United States Patent [19]

Moye

[11] Patent Number: 4,631,833

[45] Date of Patent: Dec. 30, 1986

[54] GUIDE BRACKET FOR BRICK LAYING

[76] Inventor: Henry Moye, 3023 Lippincott Blvd., Flint, Mich. 48507

[21] Appl. No.: 690,044

[22] Filed: Jan. 9, 1985

[51] Int. Cl.[4] ..... G01C 15/10

[52] U.S. Cl. ..... 33/408

[58] Field of Search ..... 33/404, 408, 407

[56] References Cited

U.S. PATENT DOCUMENTS 2,615,253 10/1952 Weathers ..... 33/408

4,285,139 8/1981 Huston ..... 33/407

*Primary Examiner*—William D. Martin, Jr.

*Attorney, Agent, or Firm*—Gifford, Groh, VanOphem, Sheridan, Sprinkle & Dolgorukov

[57] ABSTRACT

The present invention provides a guide for constructing brick corners in which the corner is constructed from a plurality of stacked brick layers which are spaced apart from each other by a joint. The guide includes at least one guide bracket having two wall sections which intersect each other at the same angle as the sides of the corner and the bracket is positioned against a partially constructed brick corner so that the wall sections flatly abut against opposite sides of the corner. A lip is formed along the top edge of each wall section and the lips are positioned on top of the top row of brick in the partially constructed corner. Several further rows of bricks are then laid on the corner so that the lip, and hence the guide bracket, is trapped within the joint between two brick layers. A pair of elongated rails are secured to the bracket so that the rails extend vertically and parallel to the corner. In addition, one side of each rail is aligned with the corner and a plumb line is slidably attached to the rail and extends to a rail on a distant corner so that the plumb line forms a guide for laying a layer of bricks. Preferably, a further guide bracket is attached to the corner at a positioned spaced vertically upwardly from the first guide bracket and the rails are attached to both guide brackets.

15 Claims, 4 Drawing Figures

GUIDE BRACKET FOR BRICK LAYING

BACKGROUND OF THE INVENTION

I. Field of the Invention

The present invention relates to a guide bracket for brick laying and, more particularly, to a guide bracket which facilitates the construction of a brick corner.

II. Description of the Prior Art

The construction of the corners in a brick building is a time consuming and tedious process. In constructing such a corner, it is necessary not only to align the bricks on each side of the corner along a vertical plumb line but it is also necessary that the bricks on each side of the corner intersect each other at a predetermined angle, typically 90°. Because of this, it has been previously necessary for brick corners to be constructed by skilled workmen and, even when skilled workmen are used to construct a corner, the construction of a corner is a time consuming, and therefore expensive, operation.

There have, however, been a number of previously known guides which are designed to facilitate the construction of brick corners. These previously known guides, however, have not proven wholly successful in use and, therefore, have not enjoyed wide spread acceptance.

One disadvantage of these previously known guides is that it is necessary to disassemble the guide at the end of each work day. Otherwise the previously known guides are known to disengage from the building while unattended and suffer damage.

A still further disadvantage of many of these previously known corner guides is that such guides are difficult and time consuming to install. Consequently, any increased efficiency obtained by the previously known guide is lost due to the difficulty and time necessary to attach the guide to the corner.

A still further disadvantage of many of the previously known brick layer corner guides is that such guides cover or otherwise obscure a substantial portion of the brick corner. Consequently, when such guides are used, as is necessary to complete the joint at the corner by filling them with mortar along the entire corner after the brick guide is removed. The necessity for filing each joint along the corner is, of course, a time consuming job to accomplish.

SUMMARY OF THE PRESENT INVENTION

The present invention provides a guide assembly for constructing brick corners which overcomes all of the above mentioned disadvantages of the previously known devices.

In brief, the guide assembly of the present invention comprises a pair of guide brackets, each of which is substantially identical to the other. Each guide bracket includes two wall sections which intersect at a predetermined angle, typically 90°, so that the wall sections flatly abut against opposite exposed sides of a partially constructed corner. In addition, a lip is formed along the top edge of each wall section so that the lips are coplanar and intersect at the angle of the corner. These lips are positioned on the top row of a partially constructed corner. Several further layers of brick are then laid in the conventional fashion on the corner so that the lips are entrapped in a joint between two brick layers thus rigidly attaching the guide bracket to the corner.

Preferably, a second guide bracket is attached to the brick corner in the identical fashion but at a position spaced upwardly from the first guide bracket.

A pair of elongated rails are detachably secured to and between the guide brackets so that the rails which extend vertically and thus parallel to the brick corner. Furthermore, one side of each rail is aligned with the corner so that a plumb line extending between one rail and a rail on another corner can be used for laying a line of bricks.

After the corner has been constructed as desired, the guide brackets are removed and the joints in which the lips were positioned are filled with mortar.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
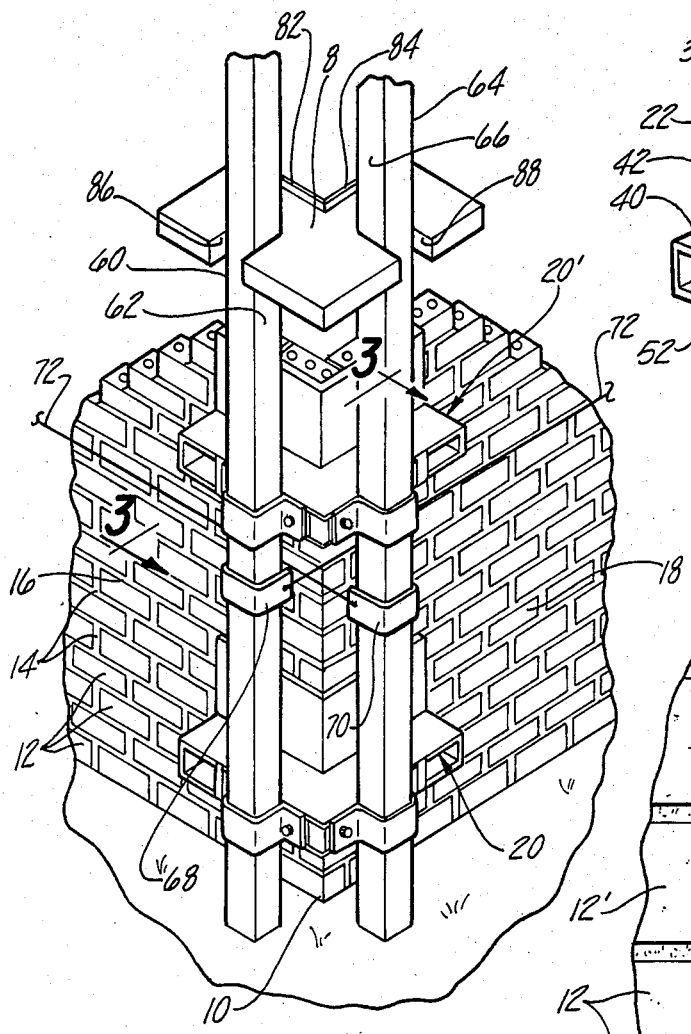
FIG. 1 is a fragmentary elevational view illustrating a preferred embodiment of the present invention.

With reference first to FIG. 1, a brick corner 10 is thereshown which is conventional in construction. As such, it comprises a plurality of stacked brick layers 12 which are spaced apart from each other by a joint 14 which is commonly filled with mortar. In addition, the corner 10 includes two planar sides 16 and 18 which intersect each other at a predetermined angle, typically 90°, so that the corner 10 extends vertically.

Still referring to FIG. 1, a preferred embodiment of the device for constructing the corner 10 is thereshown and comprises a pair of guide brackets 20 and 20'. Since the guide brackets 20 and 20' are substantially identical to each other, only the bracket 20 will be described in detail, it being understood that a like description shall also apply to the other guide bracket 20'.

Figure 2:
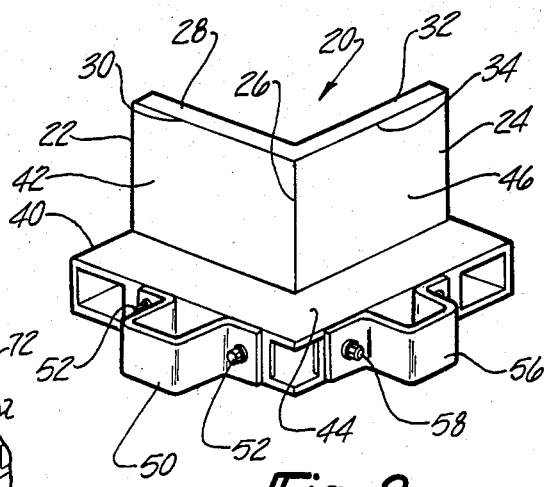
FIG. 2 is a perspective view illustrating a component of the preferred embodiment of the present invention.
Figure 3:
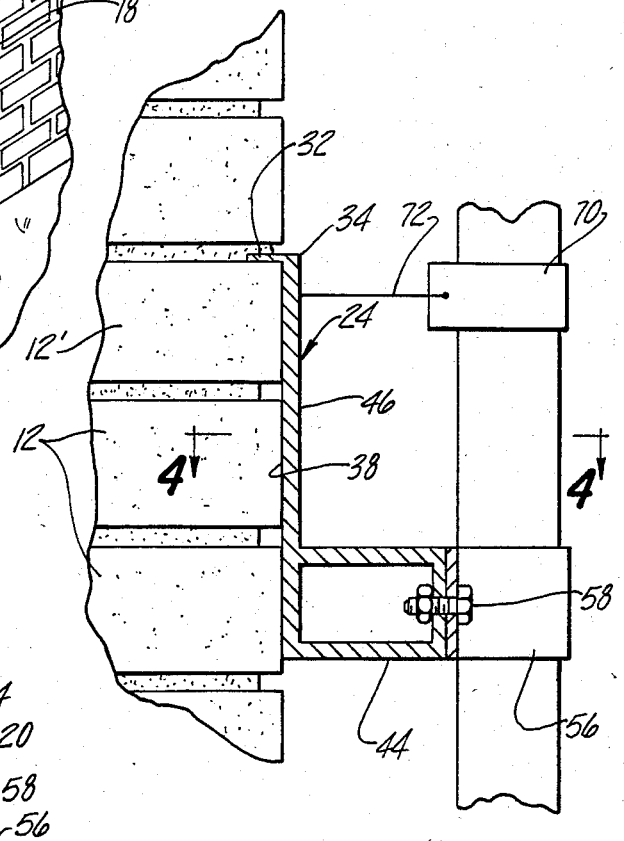
FIG. 3 is a sectional view taken substantially along line 3—3 in FIG. 1.
Figure 4:
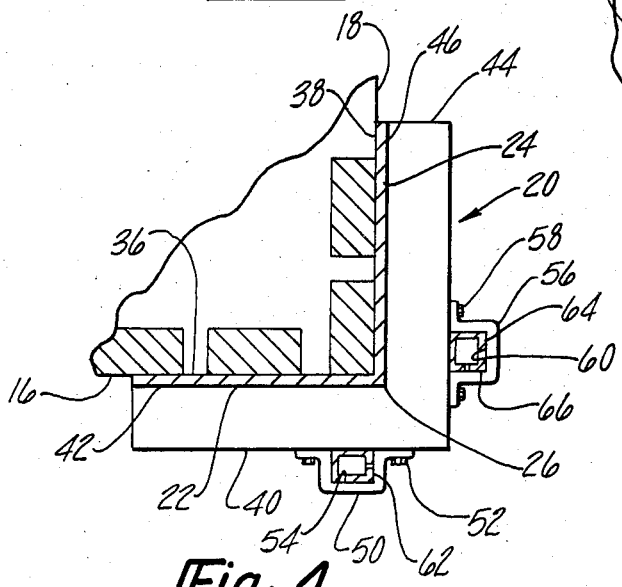
FIG. 4 is a fragmentary sectional view taken along line 4—4 in FIG. 3.

With reference now to FIGS. 2–4, the guide bracket 20 includes two planar wall sections 22 and 24 which are generally rectangular in shape and are joined together along abutting edges 26. Furthermore, the plane of the wall sections 22 and 24 intersect each other at the angle of the corner, e.g. 90°.

As best shown in FIGS. 2 and 3, an elongated lip 28 is attached to an upper edge 30 of the first wall section 22 so that the plane of the lip 28 is perpendicular to the plane of the wall section 22. Similarly, an elongated lip 32 is attached to an upper edge 34 of the wall section 24 so that the plane of the lip 32 is substantially perpendicular to the plane in the wall section 24. The lips 28 and 32 are coplanar with each other and the longitudinal axis of one lip 28 intersects the axis of the other lip 32 at the predetermined corner angle, e.g. 90°. Furthermore, the lips 28 and 32 protrude outwardly from an inner side 36 and 38 of the wall sections 22 and 24, respectively.

Referring again to FIGS. 2–4, a flange 40 is secured to the lower edge of the wall section 22 so that the flange 40 extends perpendicularly outwardly from the side 42 of the wall section 22 opposide from its side 36.

Similarly, a flange 44 extends perpendicularly outwardly from the lower edge of a side 46 of the wall section 24 opposite from its side 38. Consequently, the flanges 40 and 44 are spaced downwardly from but are substantially parallel to the lips 28 and 32.

Referring still to FIG. 2–4, a U-shaped bracket 50 is detachably secured to the flange 40 by fasteners 52 so that a channel 54 formed by the interior of the bracket 50 is substantially parallel to the abutting edges 26 of the wall sections 22 and 24. Similarly, a second U-shaped bracket 56 is detachably secured to the flange 44 by fasteners 58 so that a channel 60 formed by the interior of the bracket 56 is substantially parallel to the corner edge 26. Preferably, the fasteners 52 and 58 extend through slots in either their respective U-shaped brackets 50 and 56 or flanges 40 and 44 to allow some adjustment of the position of the brackets 50 and 56.

With reference now to FIGS. 1, 3 and 4, in operation, the brick corner 10 is partially constructed in the conventional fashion so that the cover 10 comprises several layers 12 of brick. At that time, the guide bracket 20 is positioned on the corner 10 so that the lips 28 and 32 are positioned on the top layer 12' (FIG. 3) of bricks of the partially constructed corner and so that the sides 36 and 38 of the wall sections 22 and 24 flatly abut against opposite sides 16 and 18 of the corner 10 as best shown in FIG. 4.

Several further layers of brick are then constructed on the corner 10 in the conventional fashion and the second guide bracket 20' is then attached to the partially constructed corner, as shown in FIG. 1, so that the guide brackets 20 and 20' are vertically spaced from each other along the corner 10. Furthermore, the lips 28 and 32 of the guide brackets 20 and 20' are positioned within the joint between two layers of brick so that the weight of the brick securely fastens the guide brackets 20 and 20' to the partially constructed corner 10.

With reference now to FIG. 1, a first elongated rail 60 is positioned within the channels 54 of the U-shaped brackets 50 and the brackets 50 are tightened to the guide bracket 20 by the fasteners 52. In doing so, the rail 60 extends vertically and parallel to the brick corner 10 and one side 62 of the rail is aligned with the corner 10.

Similarly, a second rail 64 is positioned within the channel 60 of the U-shaped brackets 56 and the fasteners 58 are tightened thus securing the rail 64 to the guide brackets 20. The rail 64 extend vertically parallel to the corner 10 and one side 66 of the rail 64 is substantially aligned with the corner 10.

With reference now to FIGS. 1 and 3, a slide 68 is slidably mounted in any conventional fashion along the side 62 of the rail 60 while a second slide 70 is slidably mounted along the side 66 of the other rail 64. A plumb line 72 is attached to each slide 68 and 70 and each plumb line 72 extends to a slide on a rail on a spaced corner (not shown) so that the plumb line 72 form a guide for laying a line of bricks. Furthermore, the plumb lines 72 cross each other at the brick corner 10 (FIG. 1) so that the bricks on the corner 10 can be easily properly aligned and constructed. In addition, although the plumb lines 72 are illustrated in FIG. 1 as being spaced downwardly from the top of the corner, in practice, the plumb lines are positioned along the top of the corner and form the guide for laying a top row of bricks.

With reference now to FIG. 1, in order to ensure that the rails 60 and 64 remain parallel to the brick corner 10 over long distances, the guide assembly of the present invention preferably comprises a template 8 which is generally planar and includes two edges 82 and 84 which are adapted to flatly abut against opposite sides 16 and 18 of the brick corner 10. The template 8 also includes two notches 86 and 88 which slidably receive the rails 60 and 64, respectively, therethrough in order to maintain the proper spacing between the rails 60 and 64 and the brick corner 10. Furthermore, the tension from the plumb line 72 maintains the rails 60 and 64 snugly nested within the Receiving notches 86 an 88 and thus ensure that the spacing between the rails 60 and 64 is properly maintained.

After the brick corner and the brick walls have been wholly constructed, the guide brackets 20 and 20' are removed from the brick corner. The guide brackets are constructed of a material, such as metal, to which mortar does not adhere so that such removal of the guide brackets 20 is possible. The joints 14 in which the lips 28 and 32 were positioned are then filled with mortar and the construction of the corner is completed.

A primary advantage of the present invention is that the guide brackets 20, once assembled to a partially constructed corner, are securely maintained on the corner by the corner itself. Consequently, additional guidelines, braces or the like are completely unnecessary.

A still further advantage of the present invention is that, since the lips 28 and 32 are only positioned within two joints along the corner, only minor filling of the joints is required after the guide brackets have been removed.

A still further advantage of the present invention is that, since the rails 60 and 64 are spaced apart from the sides 16 and 18 of the corner 10 by distance equal to the width of the flanges 40 and 44, relatively free and open access to the corner is obtained during construction.

Having described my invention, however, many modifications thereto will become apparent to those skilled in the art to which it pertains without deviation from the spirit of the invention as defined by the scope of the appended claims.

I claim:

1. A guide assembly for constructing a brick corner in which the corner comprises a plurality of stacked brick layers spaced from each other by horizontally extending joints, said guide assembly comprising:

at least one guide bracket, said guide bracket having two wall sections which intersect at a predetermined angle, said wall sections adapted to flatly abut against opposite exposed sides of the corner, said guide bracket having an elongated lip formed along an edge of and in a plane perpendicular to each wall section so that said lips are coplanar and intersect at said predetermined angle, said lips lying in a substantially horizontal plane and being adapted to be positioned in the horizontally extending joint between two layers of brick, a pair of elongated rails, and means for attaching said rails to said guide bracket so that said rails are spaced apart and parallel to each other and extend parallel to the corner.

2. The invention as defined in claim 1 and comprising a second guide bracket substantially identical to said first mentioned guide bracket, said second guide bracket being mounted to the corner at a position vertically spaced from the first mentioned guide bracket.

3. The invention as defined in claim 1 wherein one rail includes a side substantially aligned with said edge of one wall section and wherein the other rail includes a side substantially aligned with said edge of the other wall section.

4. The invention as defined in claim 3 and comprising at least one plumb line and means for slidably mounting said plumb line to one of said rails.

5. The invention as defined in claim 1 and comprising a template having two notches each of which slidably receives one rail, and said template having two edges which intersect at said predetermined angle and are adapted to abut against opposite exposed sides of the corner.

6. The invention as defined in claim 1 wherein said guide bracket comprises a pair of flanges which are spaced apart and parallel to said lips, said flanges extending outwardly from a side of said wall section opposite from said lips, and wherein said attaching means comprises a U-shaped attachment bracket adapted to receive said rail therethrough, and means for securing said U-shaped brackets to said flanges.

7. The invention as defined in claim 6 wherein said securing means comprise means for adjustably securing said U-shaped brackets to said flanges.

8. The invention as defined in claim 7 wherein said adjustable securing means comprise a slot in said U-shaped bracket and a threaded fastener extending through said slot and into a receiving hole in said flange.

9. A guide assembly for constructing a brick corner in which the corner comprises a pluraliy of stacked brick layers spaced from each other by joints, said guide assembly comprising:

at least one guide bracket, said guide bracket having two wall sections which intersect at a predetermined angle, said wall sections adapted to flatly abut against opposite exposed sides of the corner, said guide bracket having a lip formed along an edge of and in a plane perpendicular to each wall section so that said lips are coplanar and intersect at said predetermined angle, said lips adapted to be positioned in the joint between two layers of brick, a pair of elongated rails, means for attaching said rails to said guide bracket so that said rails are spaced apart and parallel to each other and extend parallel to the corner and a template having two notches each of which slidably receives one rail, and said template having two edges which intersect at said predetermined angle and are adapted to abut against opposite exposed sides of the corner.

10. The invention as defined in claim 9 and comprising a second guide bracket substantially identical to said first mentioned guide bracket, said second guide bracket being mounted to the corner at a position vertically spaced from the first mentioned guide bracket.

11. The invention as defined in claim 9 wherein one rail includes a side substantially aligned with said edge of one wall section and wherein the other rail includes a side substantially aligned with said edge of the other wall section.

12. The invention as defined in claim 11 and comprising at least one plumb line and means for slidably mounting said plumb line to one of said rails.

13. The invention as defined in claim 9 wherein said guide bracket comprises a pair of flanges which are spaced apart and parallel to said lips, said flanges extending outwardly from a side of said wall section opposite from said lips, and wherein said attaching means comprises a U-shaped attachment bracket adapted to receive said rail therethrough, and means for securing said U-shaped brackets to said flanges.

14. The invention as defined in claim 13 wherein said securing means comprise means for adjustably securing said U-shaped brackets to said flanges.

15. The invention as defined in claim 14 wherein said adjustable securing means comprise a slot in said U-shaped bracket and a threaded fastener extending through said slot and into a receiving hole in said flange.

* * * * *